US005706886A

United States Patent [19]

Kim

[11] Patent Number: 5,706,886

[45] Date of Patent: Jan. 13, 1998

[54] FINNED TUBE HEAT EXCHANGER

[75] Inventor: Jong-Woon Kim, Incheon, Rep. of Korea

[73] Assignee: Daewoo Electronics Co., Ltd., Seoul, Rep. of Korea

[21] Appl. No.: 666,894

[22] Filed: Aug. 1, 1996

[30] Foreign Application Priority Data

Dec. 28, 1995 [KR] Rep. of Korea ..... 95-62229

[51] Int. Cl.[6] ..... F28D 1/04

[52] U.S. Cl. ..... 165/151; 165/181; 29/890.047

[58] Field of Search ..... 165/151, 181, 165/152; 29/890.047

[56] References Cited

U.S. PATENT DOCUMENTS

| | | | |
|---|---|---|---|
| 4,615,384 | 10/1986 | Shimada et al. | 165/181 X |
| 4,756,362 | 7/1988 | Kudoh et al. | 165/151 |
| 5,042,576 | 8/1991 | Broadbent | 165/151 |
| 5,109,919 | 5/1992 | Sakuma et al. | 165/151 |
| 5,170,842 | 12/1992 | Kato et al. | 165/151 |

FOREIGN PATENT DOCUMENTS

| | | | |
|---|---|---|---|
| 0130596 | 10/1981 | Japan | 165/151 |
| 0183391 | 7/1988 | Japan | 165/151 |
| 0033595 | 2/1990 | Japan | 165/151 |
| 0242092 | 9/1990 | Japan | 165/151 |
| 4369394 | 12/1992 | Japan | 165/151 |
| 2221528 | 2/1990 | United Kingdom | 165/151 |

*Primary Examiner*—John Rivell
*Assistant Examiner*—Christopher Atkinson
*Attorney, Agent, or Firm*—Beveridge DeGrandi Weilacher & Young LLP

[57] ABSTRACT

A finned tube heat exchanger is disclosed in which the structure thereof is simple, and the heat exchanging performance is increased. The heat exchanger has a plurality of fin plates arranged in parallel with one another, and a plurality of heat exchanger tubes extending through the fin plates. Each of the fin plates has a plurality of projected strips, and the strips include first to ninth rows of strips disposed in a parallel relationship. Each of the first and ninth rows of strips is formed of a trapezoidal strip and two parallelogrammic strips, each of the second to eighth rows of strips is a strip extending between openings disposed adjacent to one another in the longitudinal direction of the fin plate. The second to eighth rows of strips are disposed not to be spaced, and two sides of each of the second to eighth rows of strips provided with leg portions are curved to have the same curvature as that of the openings adjacent to the two sides.

8 Claims, 2 Drawing Sheets

FINNED TUBE HEAT EXCHANGER

BACKGROUND OF THE INVENTION

1. Field of the Invention

The present invention relates to a heat exchanger, and more particularly, to a finned tube heat exchanger for use in an air conditioner, a refrigerator or the like.

2. Description of the Prior Art

The typical air conditioning system is a combination of electromechanical elements that operate to circulate a refrigerant fluid, e.g., one of the Freon compounds, according to a refrigeration cycle. Typically, the Freon vapor is compressed by an electrically driven compressor and the compressed vapor is cooled by being passed through a heat exchanger, commonly known as a condenser. Then the Freon vapor is passed through a second heat exchanger where it picks up heat from air within the building. The refrigerant is then returned to the compressor to undergo the cycle once again.

Generally, a conventional heat exchanger is formed of a plurality of tubes made of a highly thermal conductive metal like copper and numerous thin metallic fins attached to the tubes which conduct away heat from the tubes to transfer it to air-flow directed between and over the fins. A motor driven fan generates air-flow passing through the fins surrounding the tubes. To reduce both the cost of the structure and the power requirements of the fan directing the air-flow through the heat exchanger, it is important to maximize the rate at which the refrigerant fluid flowing through the tubes transfers heat to the air flowing past the tubes and between the fins, while keeping the air flow pressure drop through the heat exchanger low.

One solution is to increase the total area of the fins by increasing the number of fins to obtain increased transfer of heat to the air flowing therebetween. This, however, diminishes the size of the passages between the fins through which the air flows and will require a more powerful fan to provide the pressure difference to force the desired amount of air flow through the fins. An alternative is to provide the fins having a wafflelike or undulation configuration to increase the area exposed to the air flow. Unfortunately, with the latter solution, a problem arises in heat transfer boundary layers which very soon diminish the amount of heat transfer that can take place between the flowing air and the fin surfaces. In recognition of this problem, designers of heat exchangers have focused on techniques to inhibit the growth of heat transfer boundary layers while increasing flow mixing and turbulence without significantly increasing the overall pressure difference required to obtain the desired flow of air through the tubes and fin assembly.

Heat transfer by conduction must first occur between the surface of the tubes and the fins, and thereafter, by convection from the fin surfaces to the air flowing between the fins. There is also a direct transfer of heat from the surface of the tubes by convection to the air flowing past the tubes, but this generally amounts to a relatively small fraction of the overall heat transfer.

FIG. 1 shows a conventional finned tube heat exchanger. As shown in FIG. 1, a heat exchanger 1 is provided with a plurality of fin plates 2 of aluminum spaced at regular intervals and a plurality of heat exchanger tubes 3 extending through fin plates 2. Heat exchanger tubes 3 are securely held in openings formed .in fin plates 2 by any suitable means. Each fin plate 2 has a plurality of cut-out strips extending across the direction of air flow indicated by arrow A. These strips are for raising the heat exchanging performance and project upwardly from the surface of fin plates 2.

FIGS. 2A and 2B show the structure of a conventional fin plate. A plurality of louverlike strips 4 parallel with one another extend in a direction perpendicular to the direction of air flow indicated by an arrow A. Strips 4, as shown in FIG. 2B, are formed on the same side of each fin plate 2. In the conventional fin plate, there are problems that the manufacture is not easy and foreign materials such as dust included in the air flowing through strips 4 become easily attached to reduce the heat exchanging performance, since each strip 4 has a narrow width.

Additionally, in the case of strips 4 as shown in FIG. 2B, water drops tend to stay between adjacent strips 4, since strips 4 are spaced at narrow intervals. Thus, water drops stay on fin plates 2 until they grow into a considerable size, so that the heat exchanging performance is lowered and the corrosion of the heat exchanger is promoted.

SUMMARY OF THE INVENTION

To solve the above problems, an object of the present invention is to provide an improved finned tube heat exchanger in which the structure thereof is simple and the heat exchanging performance is raised.

To achieve the object of the present invention, there is provided a heat exchanger comprising:

a plurality of fin plates spaced at regular intervals, arranged in parallel with one another and adapted to allow air to flow therebetween, each fin plate having openings arranged in a longitudinal direction thereof and a leading edge arranged perpendicularly to air flow; and a plurality of heat exchanger tubes extending through the openings of the fin plates in a direction perpendicular to the planes in which the fin plates lie and being adapted to allow a refrigerant fluid to pass therein, each of the fin plates having a plurality of strips projected from the surface of the fin plates and extending perpendicularly to a direction in which air is to flow between the fin plates, the strips being composed of first to ninth rows of strips arranged between the openings, which are disposed adjacent to one another, along the longitudinal direction of the fin plates in a parallel relationship.

The first row of strips is located near the leading edge of the fin plates and consists of a trapezoidal strip having a long side located on the upper stream of the air flow and two parallelogrammic strips located on both sides of the trapezoidal strip in the longitudinal direction, each of the second to eighth rows of strips consists of a strip extending between the openings disposed adjacent to one another in the longitudinal direction, and the ninth row of strips consists of a trapezoidal strip having a long side located on the lower stream of the air flow and two parallelogrammic strips located on both sides of the trapezoidal strip in the longitudinal direction.

In the first to ninth rows of strips, two opposing sides of each of them, facing the air flow, are opened by cutting and the other two sides thereof are provided with leg portions for connecting the first to ninth rows of strips with the fin plates.

The first, second, fourth, sixth, eighth and ninth rows of strips are formed on the same side of the fin plates, while the third, fifth and seventh rows of strips are formed on the other side thereof. Accordingly, the first to fourth rows of strips are disposed in a symmetric relationship with the sixth to ninth rows of strips with respect to the fifth row of strips.

Preferably, the second row of strips is disposed to be spaced from the first row of strips at an interval and the ninth row of strips is disposed to be spaced from the eighth row of strips at an interval, while the second to eighth rows of strips are disposed not to be spaced.

Moreover, two sides of each of the second to eighth rows of strips provided with the leg portions are curved to have the same curvature as that of openings adjacent to the two sides.

BRIEF DESCRIPTION OF THE DRAWINGS

The above object and other advantages of the present invention will become more apparent by describing in detail preferable embodiments thereof with reference to the attached drawings in which.

DETAILED DESCRIPTION OF THE PREFERRED EMBODIMENT

Hereinafter, the preferred embodiment of a finned tube heat exchanger according to the present invention will be described in detail with reference to FIGS. 3 and 4.

Similar to the conventional finned tube heat exchanger, a heat exchanger of the present invention is provided with a plurality of fin plates 10 spaced at regular intervals and a plurality of heat exchanger tubes 12 extending through fin plates 10. Heat exchanger tubes 12 are securely held in openings 14 formed in fin plates 10. Each fin plate 10 has a plurality of cut-out strips extending along a direction perpendicular to the direction of air flow indicated by arrow A. These strips are for raising the heat exchanging performance and project upwardly from the surface of fin plates 10.

Figure 1:
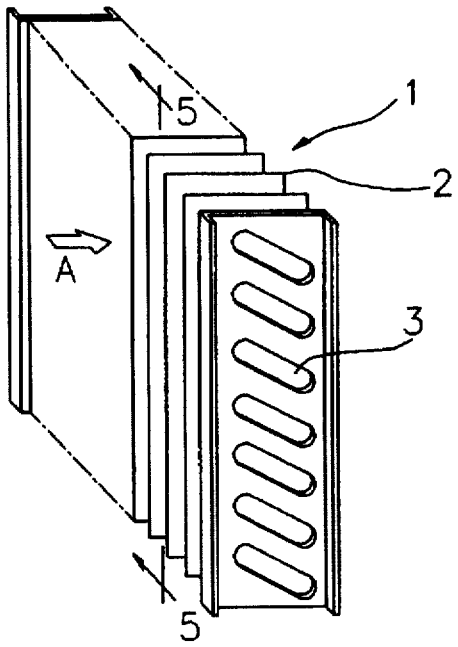
FIG. 1 PRIOR ART
FIG. 1 is a perspective view of a conventional finned tube heat exchanger.
Figure 2A:
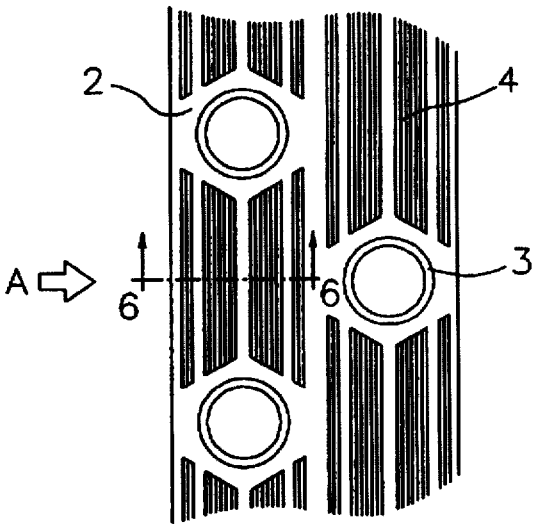
FIG. 2A PRIOR ART
FIG. 2A is a front view of a conventional finned tube heat exchanger taken along the lines 5—5 in FIG. 1.
Figure 2B:
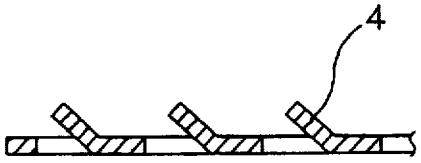
FIG. 2B PRIOR ART
FIG. 2B is an enlarged partial sectional view taken along the lines 6—6 in FIG. 2A.
Figure 3:
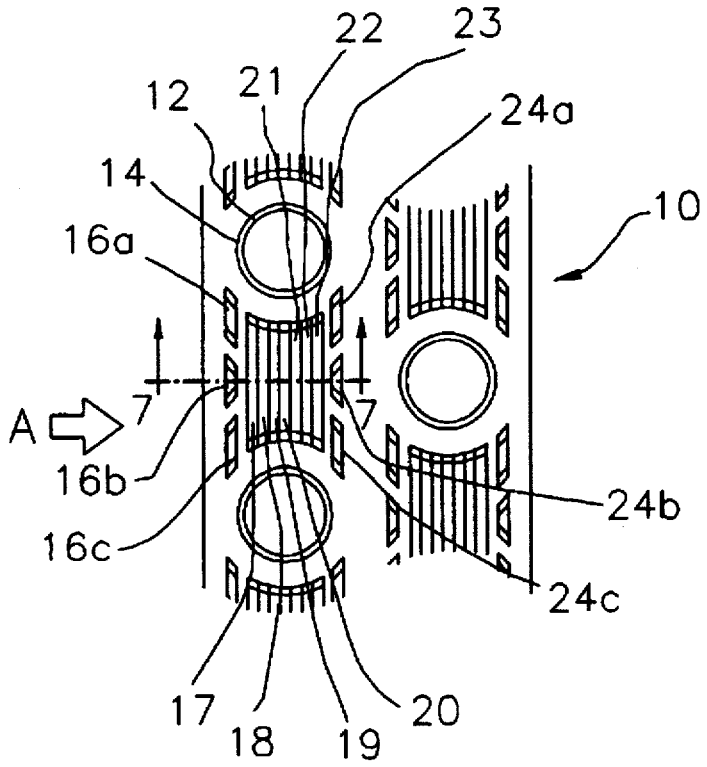
FIG. 3 is a front view of a fin plate according to the present invention.

FIG. 3 shows a fin plate 10 mounted in a finned tube heat exchanger according to the preferred embodiment of the present invention.

Fin plate 10 is made of aluminum and preferably, has a thickness of 0.12 mm. As shown in FIG. 3, strips **16*a*–16*c*, 17–23 and 24*a*–24*c* extend in a direction perpendicular to the direction of air flow indicated by arrow A. strips 16*a*–16*c*, 17–23 and 24*a*–24*c* project upwardly from the surface of fin plate 10 so that strips 16*a*–16*c* and 24*a*–24*c* have a height of, preferably, 1.0 mm and other strips 17–23 have a height of, preferably, 0.6 mm. All of strips 16*a*–16*c*, 17–23 and 24*a*–24*c* have a width of, preferably, 0.96 mm. Moreover, all of strips 16*a*–16*c*, 17–23 and 24*a*–24*c* are bridgelike, and each of them has two leg portions for connecting it with fin plate 10**.

The first row of strips located near a leading edge of fin plate 10 in the direction of air flow between two adjacent heat exchanger tubes 14 consists of three projected strips **16*a*–16*c*. Strip 16*b* is provided in a form of a trapezoid having a long side located on the upper stream of the air flow and is located between remaining strips 16*a* and 16*c*. Strips 16*a* and 16*c* are provided in a form of a parallelogram and are located on both sides of strip 16*b* in the longitudinal direction of fin plate 10**.

The second row of strips is disposed to be spaced from the first row of strips at an interval. The second to eighth rows of strips consist of seven projected strips 17–23 respectively and are disposed not to be spaced therebetween in a parallel relationship. Two opposing sides of each of strips 17–23, facing the air flow, are opened by cutting and the other two sides are provided with leg portions for connecting strips 17–23 with fin plate 10. Two sides of the respective strips 17–23 provided with the leg portions are curved to have the same curvature as that of openings 14 adjacent to the two sides.

The ninth row of strips consists of three projected strips **24*a*–24*c*. Strip 24*b* is provided in a form of a trapezoid having a long side located on the lower stream of the air flow and is located between remaining strips 24*a* and 24*c*. Strips 24*a* and 24*c* are provided in a form of a parallelogram and are located on both sides of strip 24*b* in the longitudinal direction of fin plate 10**.

Figure 4:
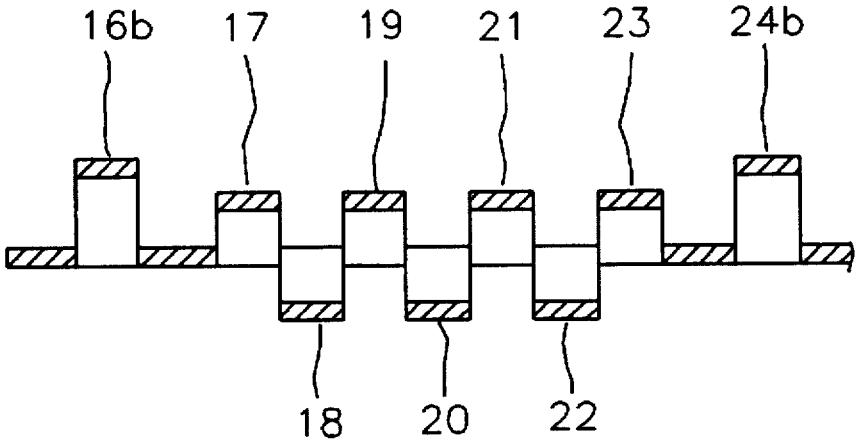
FIG. 4 is an enlarged sectional view taken along the lines 7—7 in FIG. 3.

As shown in FIG. 4, strips **16*a*–16*c*, 17, 19, 21, 23 and 24*a*–24*c* are formed on one side of fin plate 10, while strips 18, 20 and 22** are formed on the other side thereof. Accordingly, the first to fourth rows of strips are disposed in a symmetric relationship with the sixth to ninth rows of strips with respect to the fifth row of strips.

As clearly described in the above, the effects of the heat exchanger according to the present invention are as follows:

(1) Since strips of the heat exchanger according to the present invention have a wide width and are spaced at wide intervals in comparison with those of the conventional heat exchanger, the manufacture is easy and foreign materials such as dust are less likely to become attached to maintain the constant heat exchanging performance.

(2) Since flow mixing is increased by means of projected strips, the growth of heat transfer boundary layers is inhibited to increase the heat exchanging performance. Thus, the size of the heat exchanger may be reduced.

(3) Since the interval between the strips becomes relatively wide, water drops on the fin plates drop readily. Thus, there is no case that the heat exchanging performance is lowered, and the corrosion of the heat exchanger is prevented.

While the present invention has been particularly shown and described with reference to preferred embodiment thereof, it will be understood by those skilled in the art that various changes in form and details may be effected therein without departing from the spirit and scope of the invention as defined by the appended claims.

What is claimed is:

1. A heat exchanger comprising:

a plurality of fin plates spaced at regular intervals, arranged in parallel with one another and adapted to allow air to flow therebetween, each fin plate having openings arranged in a longitudinal direction thereof and a leading edge arranged perpendicularly to air flow; and a plurality of heat exchanger tubes extending through said openings of said fin plates in a direction perpendicular to the planes in which said fin plates lie and being adapted to allow a refrigerant fluid to pass therein, each of said fin plates having a plurality of strips projected from the surface of said fin plates and extending perpendicularly to a direction in which air is to flow between said fin plates, said strips being composed of first to ninth rows of strips arranged between said openings, which are disposed adjacent to one another, along the longitudinal direction of said fin plates in a parallel relationship, said first row of strips being located near the leading edge of said fin plates and consisting of a trapezoidal strip having a long side located on the upper stream of the air flow and two parallelogrammic strips located on both sides of said trapezoidal strip in the longitudinal direction, each of said second to eighth rows of strips consisting of a strip extending between said openings disposed adjacent to one another in the longitudinal direction, said ninth row of strips consisting of a trapezoidal strip having a long side located on the lower stream of the air flow and two parallelogrammic strips located on both sides of said trapezoidal strip in the longitudinal direction, two opposing sides of each of said first to ninth rows of strips, facing the air flow, being opened by cutting and the other two sides thereof being provided with leg portions for connecting said first to ninth rows of strips with said fin plates, wherein said first, second, fourth, sixth, eighth and ninth rows of strips are formed on the same side of said fin plates, while said third, fifth and seventh rows of strips are formed on the other side thereof.

2. The heat exchanger as claimed in claim 1, wherein said first and ninth rows of strips have a projecting height of about 1.0 mm.

3. The heat exchanger as claimed in claim 1, wherein said second to eighth rows of strips have a projecting height of about 0.6 mm.

4. The heat exchanger as claimed in claim 1, wherein said first to ninth rows of strips have a width of about 0.96 mm.

5. The heat exchanger as claimed in claim 1, wherein said first to fourth rows of strips are disposed in a symmetric relationship with said sixth to ninth rows of strips with respect to said fifth row of strips.

6. The heat exchanger as claimed in claim 1, wherein said second row of strips is disposed to be spaced from said first row of strips at an interval and said ninth row of strips is disposed to be spaced from said eighth row of strips at an interval, while said second to eighth rows of strips are disposed not to be spaced.

7. The heat exchanger as claimed in claim 1, wherein two sides of each of said second to eighth rows of strips provided with said leg portions are curved to have the same curvature as that of openings adjacent to the two sides.

8. A heat exchanger comprising:

a plurality of fin plates spaced at regular intervals, arranged in parallel with one another and adapted to allow air to flow therebetween, each fin plate having openings arranged in a longitudinal direction thereof and a leading edge arranged perpendicularly to air flow; and a plurality of heat exchanger tubes extending through said openings of said fin plates in a direction perpendicular to the planes in which said fin plates lie and being adapted to allow a refrigerant fluid to pass therein, each of said fin plates having a plurality of strips projected from the surface of said fin plates and extending perpendicularly to a direction in which air is to flow between said fin plates, said strips being composed of first to ninth rows of strips arranged between said openings, which are disposed adjacent to one another, along the longitudinal direction of said fin plates in a parallel relationship, said first row of strips being located near the leading edge of said fin plates and consisting of a trapezoidal strip having a long side located on the upper stream of the air flow and two parallelogrammic strips located on both sides of said trapezoidal strip in the longitudinal direction, each of said second to eighth rows of strips consisting of a strip extending between said openings disposed adjacent to one another in the longitudinal direction, said ninth row of strips consisting of a trapezoidal strip having a long side located on the lower stream of the air flow and two parallelogrammic strips located on both sides of said trapezoidal strip in the longitudinal direction, two opposing sides of each of said first to ninth rows of strips, facing the air flow, being opened by cutting and the other two sides thereof being provided with leg portions for connecting said first to ninth rows of strips with said fin plates, said first and ninth rows of strips having a projecting height of about 1.0 mm, said second to eighth rows of strips having a projecting height of about 0.6 mm, said first to ninth rows of strips having a width of about 0.96 mm, said first, second, fourth, sixth, eighth and ninth rows of strips being formed on the same side of said fin plates, said third, fifth and seventh rows of strips being formed on the other side thereof, said first to fourth rows of strips being disposed in a symmetric relationship with said sixth to ninth rows of strips with respect to said fifth row of strips, said second row of strips being disposed to be spaced from said first row of strips at an interval, said ninth row of strips being disposed to be spaced from said eighth row of strips at an interval, said second to eighth rows of strips being disposed not to be spaced, two sides of each of said second to eighth rows of strips provided with said leg portions being curved to have the same curvature as that of openings adjacent to the two sides.

* * * * *